United States Patent [19]

Siciliano

[11] Patent Number: 4,675,915

[45] Date of Patent: Jun. 30, 1987

[54] ARTICLE OF WEARING APPAREL SUITABLE FOR CONTROLLING BODY PERSPIRATION

[76] Inventor: Anthony Siciliano, Rowayton Gardens, Apt. 21 Trolley Pl., Rowayton, Conn. 06853

[21] Appl. No.: 881,090

[22] Filed: Jul. 2, 1986

[51] Int. Cl.[4] ..... A42C 5/02; A43B 17/10

[52] U.S. Cl. ..... 2/181; 2/239; 2/DIG. 11

[58] Field of Search ..... 2/181, 171, 174, 53, 2/60, DIG. 11, 239; 604/358, 378

[56] References Cited

U.S. PATENT DOCUMENTS

| | | | |
|---|---|---|---|
| 1,597,558 | 8/1926 | Walters | 2/181 |
| 1,664,307 | 3/1928 | Millard | 2/181 |
| 1,895,861 | 1/1933 | Philips | 2/181 |
| 2,044,038 | 6/1936 | Wintjen | 2/181 |
| 2,544,798 | 3/1951 | Lippmann | 2/181 |
| 3,578,736 | 5/1971 | Dootson | 2/181 |
| 4,502,156 | 3/1985 | Wishman | 2/181 |
| 4,517,685 | 5/1985 | Lesley | 2/DIG. 11 |
| 4,521,922 | 1/1985 | Mitchell et al. | 2/DIG. 11 |

*Primary Examiner*—Werner H. Schroeder
*Assistant Examiner*—T. Graveline
*Attorney, Agent, or Firm*—Felfe & Lynch

[57] ABSTRACT

The present invention relates to an article of wearing apparel, which is suitable for controlling body perspiration and eliminating the problems associated therewith.

9 Claims, 5 Drawing Figures

ARTICLE OF WEARING APPAREL SUITABLE FOR CONTROLLING BODY PERSPIRATION

BACKGROUND OF THE INVENTION

The present invention relates to an article of wearing apparel, which is suitable for controlling body perspiration and eliminating the problems associated therewith cited hereinafter.

An inconvenience, and in some instances a problem, which accompanies the participation by individuals in any form of vigorous physical exercise is how to cope with or control the perspiration which results therefrom. For example, when jogging, playing tennis, basketball or some other athletic sport, the perspiration which results from such more or less vigorous activity can cause a variety of problems ranging from inability to securely grasp the racket or ball due to sweaty palms, irritation to the eyes as a result of sweat from the brow flowing into them, to the formation of blisters on the soles and heels of the feet due to the abrasive action of wet socks constantly rubbing against the aforementioned areas of the foot during movement.

The ordinary sweatbands found on the market today for the most part consist of tubular sections of moisture-absorbent material, such as terry cloth, which absorbs the perspiration from the body. Once the saturation point of the moisture-absorbent material is reached, the moisture will then flow from the sweat bands onto the body as if it were not there.

SUMMARY OF THE INVENTION

The perspiration controlling article of the present invention is adapted to be worn on the body and continuously keeps the adjacent parts of the body on which it is worn substantially dry and does not suffer from the inefficiencies of prior art items with respect to keeping such parts of the body dry. The article of the present invention, which for the sake of convenience is referred to herein as a "sweat band", dissipates perspiration as a result of its construction. It comprises two sleeves consisting of an outer sleeve and an inner sleeve disposed inside the outer sleeve and in continuous contact with it. The outer sleeve is made of any moisture-absorbent material, such as 100% cotton and/or wool fabric in any convenient weave and form, or it can be up to 80% cotton and/or wool in combination with a synthetic fiber to form the fabric. The inner sleeve is made of a 100% percent synthetic non-moisture-absorbent fabric made from polyamide such as nylon, or polyester, rayon, etc.

The inner and outer sleeves mentioned above each have top edge portions and bottom edge portions. The terms "top" and "bottom" refer to the relative position of the sleeves while worn on the portion of the body when in use. A person who is perspiring experiences a flow of perspiration which, due to gravity, travels down various parts of the body from head to foot or in the case of the arms to the outer extremities, i.e., the hands. The sweat band of the present invention, when used on the head or limb is always positioned so that the top edge portions of the sleeves face and stem the flow of perspiration as it travels due to gravity down the forehead, arms or legs of the individual.

The respective edge portions of the inner and outer sleeves are aligned in a staggered position relative to each other so that the outer sleeve top edge portion overlaps and thus extends beyond the the inner sleeve top edge portion and correspondingly, the inner sleeve bottom edge portion extends beyond the outer sleeve bottom edge portion at the other edge of the article. The aforementioned sleeves are affixed together at an appropriate location along their horizontal axes using any suitable means such as sewing, stiching, gluing, etc.

The article of the present invention can be used as a sweat band on the forehead, on the wrist, around the neck, waist, chest or on the leg preferably just above the ankle. If desired, the sweat band of the present invention can take the form of a strip having fasteners such as the Velcro® brand adhesive material fastener, or snaps, etc., at each end of the strip to fasten the ends together in order to hold it in the circular form in which it is used when in place on the body.

BRIEF DESCRIPTION OF THE DRAWINGS

While the specification concludes with claims particularly pointing out and distinctly claiming the subject matter of the invention, it is believed the invention will be better understood from the following description taken in conjunction with the accompanying drawings, wherein:

DESCRIPTION OF THE PREFERRED EMBODIMENT

Figure 1:
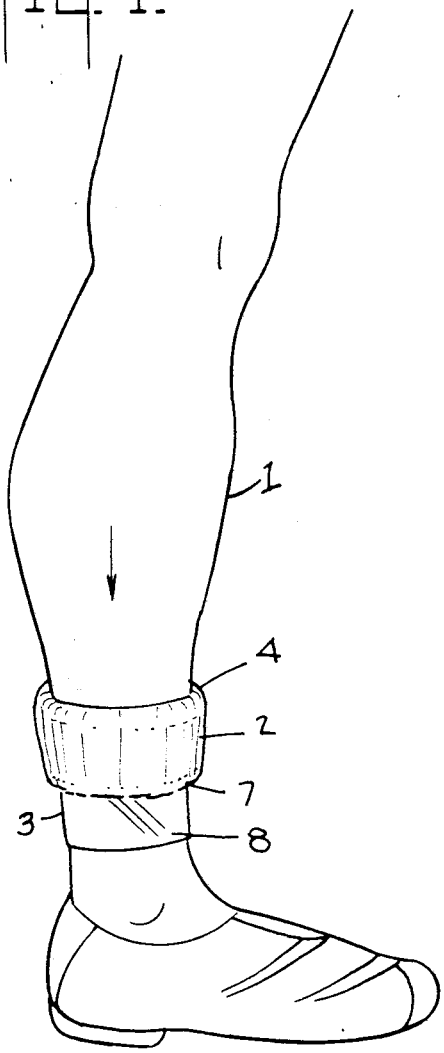
FIG. 1 illustrates the article in place on the leg just above the ankle.

Referring now more particularly to the accompanying drawings which show several of the preferred embodiments of the invention, FIG. 1 shows leg 1 having the sweat band article of the present invention comprising moisture-absorbent outer sleeve 2 over non-moisture-absorbent sleeve 3 in place just above the ankle. The arrow indicates the downward direction of flow of the perspiration as it travels down leg 1. The top edge 4 of outer sleeve 2 is in direct contact with leg 1. Bottom edge 7 of sleeve 2 covers and is positioned over inner sleeve 3. Bottom edge 8 of inner sleeve 3 is in direct contact with the leg and extend beyond bottom edge 7 of sleeve 2.

Figure 2:
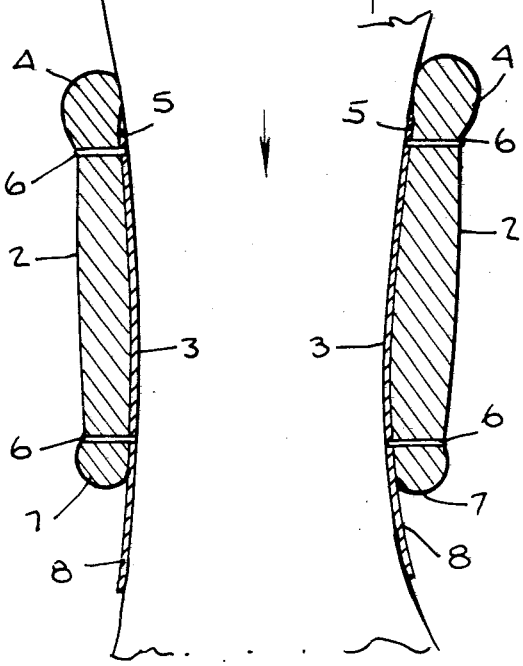
FIG. 2 shows a cross sectional view of the article in place on the body.

To specifically exemplify the article of the present invention, FIG. 2 shows a frontal cross section of the invention in place on a part of the body. Referring to moisture-absorbent outer sleeve 2, the perspiration flowing down the leg is absorbed by outer sleeve 2 at the top edge portion 4 which is in direct contact with the leg. The perspiration, absorbed and dispersed at top edge 4, travels down the body of sleeve 2 until it contacts the top edge 5 of the inner sleeve 3 which is fixed to the outer sleeve 2 at stitch 6. The inner sleeve 3, being non-absorbent, forms a continuous barrier to the perspiration absorbed by outer sleeve 2 at top edge 4 and therefore does not allow the perspiration to travel along the surface of the leg but deflects it away onto the outer sleeve 2 so that the perspiration continues to flow through outer sleeve 2 without permeating or penetrating inner sleeve 3.

FIG. 2 further shows how the positions of outer sleeve 2 and inner sleeve 3 are staggered in relation to each other. The top edge 4 of sleeve 2 is in direct contact with the leg. Top edge 5 of inner sleeve 3 is conveniently spaced a suitable distance beneath top edge 4 of outer sleeve 2. Correspondingly, bottom edge 8 of inner sleeve 3 extends beyond the bottom edge 7 of outer sleeve 2. The dimensions of outer sleeve 2 and inner sleeve 3 need not be equal. All that is required is that there must be an absorbent portion 4 of outer sleeve 2 extending above the top 5 of of the inner sleeve 3 and the bottom edge 8 of inner sleeve 3 must extend below the bottom edge 7 of outer sleeve 2. In addition, top edge 4 of outer sleeve 2 must always be the first area of contact of the sweat band unit for the oncoming flow of perspiration traveling down the body to the extremities of the limbs.

A typical preferred embodiment of the commercial configuration of the sweat band shown in FIG. 2 is to have outer sleeve top edge portion 4 extend beyond inner sleeve top edge portion 5 by a distance of about one-fourth to three-fourths of an inch, generally about one-half inch, and the inner sleeve bottom edge portion 8 extends beyond outer sleeve bottom edge portion 7 by a distance of about one-half inch to one and one-half inches, generally about one inch.

Figure 3:
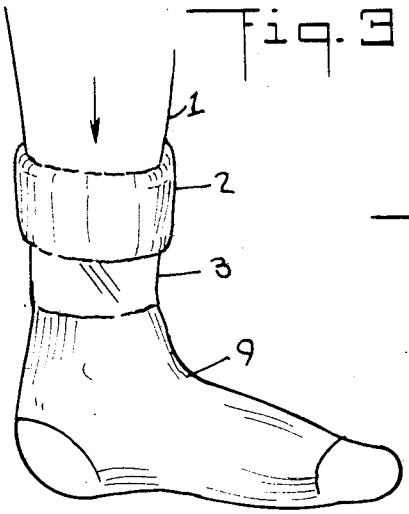
FIG. 3 shows the article in combination with a sock.

FIG. 3 shows the invention comprising sleeves 2 and 3 as described above for FIG. 2 in integral combination with a fabric sock 9. The arrow depicts the flow of perspiration.

Figure 4:
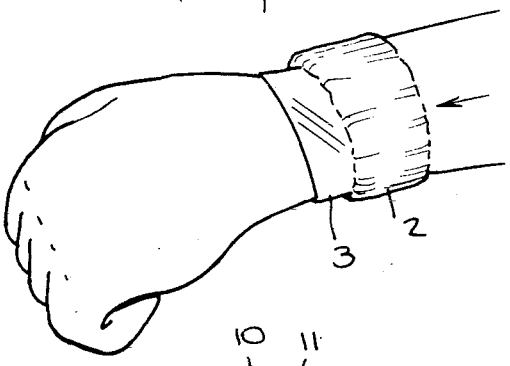
FIG. 4 shows the article in place on a wrist.

FIG. 4 is an embodiment of the invention which is shown in place on a wrist. Sleeves 2 and 3 are as described above for FIG. 2 and the arrow depicts the flow of perspiration.

Figure 5:
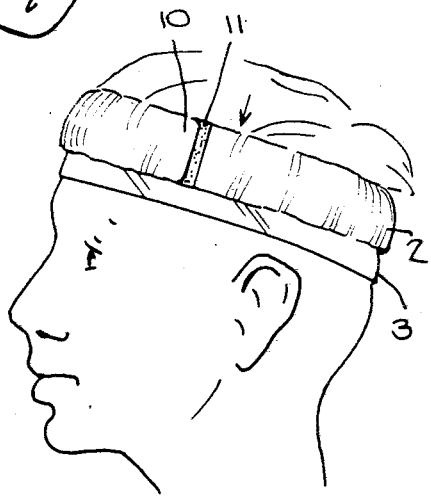
FIG. 5 shows the article and end fasteners in place around the forehead.

FIG. 5 shows a head band having sleeves 2 and 3 as described above and depicts the sweat band fastened together using the Velcro® brand adhesive material fastener with segment 10 overlapping and joining with segment 11. The arrow depicts the flow of perspiration.

With respect to FIG. 1, since the inner sleeve 3 does not allow the moisture to penetrate onto leg 1 as perspiration is seeping down the outer sleeve 2, one thought is that outer sleeve 2 acts as a reservoir for the perspiration moisture since inner sleeve 3 resists absorption all along its surface behind and beneath outer sleeve 2. There is as a result an increased tendency for the perspiration in outer sleeve 2 to evaporate or to be shaken off during the movement associated with the exercise process.

A test was devised to compare the efficiency of the article of the present invention with a standard terry cloth wrist band as the control.

The control wrist band about two inches wide was placed on the subject's left wrist. Using an atomizer spray bottle, the portion of the subject's arm just below the left elbow was subjected to ten sprays of water from the atomizer nozzle every fifteen seconds for ten minutes. During the entire test period the subject moved his left arm back and forth simulating the arm movement while walking. After approximately eight minutes, water from the control wrist band was fully saturated and water from the control wrist band was seeping into the subject's hand.

The article of the present invention in the form of a wrist band of identical width, comprising cotton fabric as the moisture-absorbent material forming the outer sleeve and nylon fabric as the non-moisture-absorbent material forming the inner sleeve, was placed over the subject's left wrist with the circumference of the cotton fabric upper edge portion of the outer sleeve in contact with the left lower forearm and the nylon fabric bottom edge of the inner sleeve surrounded the area near the left wrist bone. The identical procedure was used with the atomizer spray bottle and arm movement as was used with the control wrist band test and after ten minutes of such treatment there was substantially no seepage of water into the subject's hand. The result of the comparison was that the control band was substantially more saturated with water than the article of the present invention at the end of the respective ten minute test periods.

In the foregoing specification the presently preferred embodiments of the invention are described; however, it will be understood that the invention can be otherwise embodied within the scope of the following claims.

I claim:

1. An article of wearing apparel adapted to be worn on a part of the body and suitable for controlling body perspiration comprising:

an outer sleeve made of moisture-absorbent material; and an inner sleeve made of a non-moisture-absorbent material disposed within said outer sleeve;

said outer and inner sleeves having top and bottom edge portions which are aligned in staggered positions relative to each other so that at one end, said outer sleeve top edge portion extends beyond the inner sleeve top edge portion thereof, and correspondingly said inner sleeve bottom edge portion extends beyond the outer sleeve bottom edge portion at the other end thereof, said outer sleeve top edge portion, said inner sleeve top edge portion and said inner sleeve bottom edge portion being in direct contact with the body part on which the wearing apparel is worn.

2. The article defined in claim 1 wherein the outer sleeve is made of a moisture-absorbent material comprising cotton.

3. The article defined in claim 1 wherein the inner sleeve is made of a non-moisture-absorbent material comprising a polyamide.

4. The article defined in claim 1 wherein the outer sleeve is made of a moisture-absorbent material comprising wool.

5. The article defined in claim 1 wherein the outer sleeve is made of a moisture-absorbent material comprising cotton and the inner sleeve is made of a non-moisture-absorbent material comprising a polyamide.

6. The article defined in claim 1 which is adapted to be worn on the wrist.

7. The article defined in claim 1 which is adapted to be worn on the leg.

8.The article defined in claim 1 which is adapted to be worn on the head.

9. The article defined in claim 1 which is adapted to be worn in integral combination with a sock.

* * * * *